US005713236A

United States Patent [19]

Genet et al.

[11] Patent Number: 5,713,236

[45] Date of Patent: Feb. 3, 1998

[54] PICK AND PLACE TRANSFER

[75] Inventors: Steve C. Genet; Richard J. McClellan, both of Tiffin, Ohio

[73] Assignee: The National Machinery Company,, Tiffin, Ohio

[21] Appl. No.: 385,324

[22] Filed: Feb. 8, 1995

[51] Int. Cl.[6] ..... B21D 43/05

[52] U.S. Cl. ..... 72/405.15; 72/405.16; 470/95; 470/109; 470/154; 470/177

[58] Field of Search ..... 72/405.05, 405.16, 72/405.15, 405.13; 470/95, 109, 154, 177

[56] References Cited

U.S. PATENT DOCUMENTS

| | | | |
|---|---|---|---|
| 2,721,343 | 10/1955 | Friedman | 470/177 |
| 2,728,267 | 12/1955 | Schaeffer et al. | 10/12 |
| 3,259,929 | 7/1966 | van de Meerendonk | 10/76 |
| 3,512,391 | 5/1970 | Bozich | 72/405.15 |
| 3,604,242 | 9/1971 | Allebach et al. | 72/421 |
| 3,685,070 | 8/1972 | McClellan et al. | 10/12 T |
| 4,398,408 | 8/1983 | Wisebaker | 72/405.13 |
| 4,875,931 | 10/1989 | Monteiro | 72/405.16 |
| 4,898,017 | 2/1990 | Hite et al. | 72/405 |

FOREIGN PATENT DOCUMENTS

| | | | |
|---|---|---|---|
| 3714872 | 11/1988 | Germany . | |
| 238437 | 10/1986 | Japan | 470/95 |
| 1873693 | 11/1990 | Japan . | |
| 967056 | 8/1964 | United Kingdom . | |

*Primary Examiner*—Daniel C. Crane

*Attorney, Agent, or Firm*—Pearne, Gordon, McCoy & Granger LLP

[57] ABSTRACT

A transfer mechanism for a progressive forging machine in which the fingers for transporting workpieces from station to station are arranged to pick the workpieces axially out of dies from which they are being discharged, transfer the workpieces laterally from the discharging stations to receiving stations, place the workpieces axially into the receiving stations, and then open wide enough to clear tooling on the slide and return to the original delivery stations. Included in the mechanism is an adjustment for the axial stroke of the fingers and a cassette mounting for the fingers enabling them to be readily replaced with another cassette for a changeover in the workpieces being forged.

9 Claims, 6 Drawing Sheets

PICK AND PLACE TRANSFER

BACKGROUND OF THE INVENTION

The invention relates to metal forming machines and, in particulars to a multiple station forging machine with novel apparatus for transferring workpieces between stations.

PRIOR ART

In multiple station or progressive forging machines, a mechanical transfer device is typically employed to move a workpiece from station to station for successive forming operations. Various types of transfers have been known and are shown, for example, in U.S. Pat. Nos. 3,604,242, 3,685,070 and 4,898,017, each assigned to the assignee of the present invention. With prior transfer devices, it can be difficult to handle relatively short workpieces particularly when such parts have large heads and/or multiple steps in their diameter or cross section. When such short and/or multiple stepped pieces are kicked out of a die, they tend to fall out of the die before they can be adequately supported by a transfer mechanism. A further problem in the production of parts with relatively large heads is that the tooling punches are correspondingly large and it can be impractical to immediately to move the workpiece gripping elements of the transfer through a return stroke without interference with such tools. One known type of transfer includes a pivoted carrier to swing the tips of the transfer fingers axially relative to the dies to withdraw and insert workpieces out of and into the dies, but this device lacks provisions for selectively opening the fingers and relies on simple springs to bias the fingers to a closed position.

SUMMARY OF THE INVENTION

The invention provides a transfer device for a multiple station forging machine that is particularly suited for handling short workpieces including those with large heads and/or stepped shapes. The transfer employs a novel combination of movements which enable it to pick workpieces axially out of the dies, transfer them to successive dies and axially place them into the successive dies and then return over even large diameter tooling on the slide when such tooling is extended at the dies. The transfer elements can grip a workpiece before it is completely ejected from a die so that the risk of dropping the workpiece is essentially eliminated. Similarly, the transfer safely grips a workpiece until it is adequately placed into and contained by a subsequent die.

In the disclosed embodiments workpiece engaging elements of the transfer at each station are in the form of opposed pivoted fingers. The fingers are supported on a common carrier assembly that swings about a strategically located pivot axis that produces primarily axial motion at the workpiece gripping surfaces of the transfer fingers. This pivoting motion involves relatively little mass and consequently can be performed in a relatively short period both when withdrawing a workpiece and when positioning a workpiece in a subsequent die. The carrier is supported in the frame for translatory motion through a stroke equal to the distance between adjacent die stations.

The transfer finger opening and closing movement is characterized by a high lift that radially displaces them from the die centers. This high lift geometry allows the transfer fingers to pass over even large tools extended into the delivery die stations and to return to the original pick-up or receiving station.

The transfer is constructed in such a way that the finger opening and closing control elements are, for the most part, mounted independently of the finger carrier so that the mass supported on the carrier is reduced and high inertia loads are avoided even at high speed operation.

DESCRIPTION OF THE PREFERRED EMBODIMENT

Figure 8:
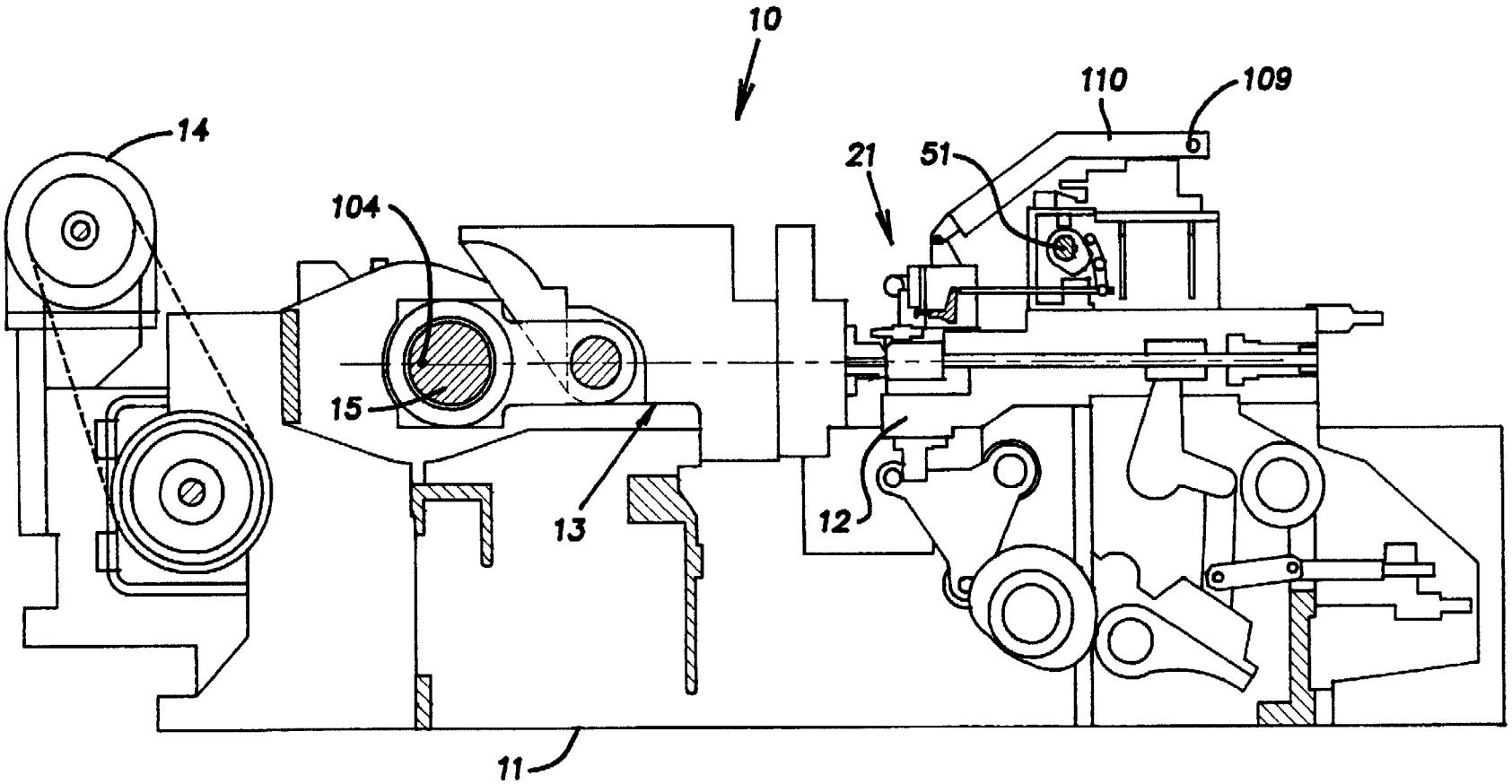
FIG. 8 is a schematic side view partially in section of a forging machine including the transfer apparatus.

A forging machine 10, shown somewhat schematically in FIG. 8; includes a frame 11 having a die breast 12. A slide 13 is reciprocated horizontally by a crankshaft 15 towards and away from the die breast 12 on suitable bearings in a known manner. The crankshaft 15 and slide 13 and other mechanisms to be described are driven by a motor 14 through associated pulleys and sprockets on the frame 11. The illustrated forging machine 10 is a progressive forming type and has a plurality of die stations 16 equally spaced from one another in a horizontal plane across a face 17 of the die breast 12. In the illustrated case, the machine 10 has 8 die stations but it will be understood that the invention is applicable to machines having other numbers of die stations.

A transfer mechanism 21, constructed in accordance with the invention, moves workpieces successively between the die stations 16. During operation, as described more fully hereinbelow, the transfer mechanism 21 is effective to pick individual workpieces axially out of dies from which they are discharged after a forging blow, move the workpieces laterally to successive receiving dies, move the workpieces axially into the receiving dies for the next forging blow, and then, with the workpiece gripping elements of the transfer open, return the gripping elements to the original respective die stations while tooling or punches 19 on the slide 13 are at or adjacent the tooling or dies 18 in the die stations 16.

Figure 3:
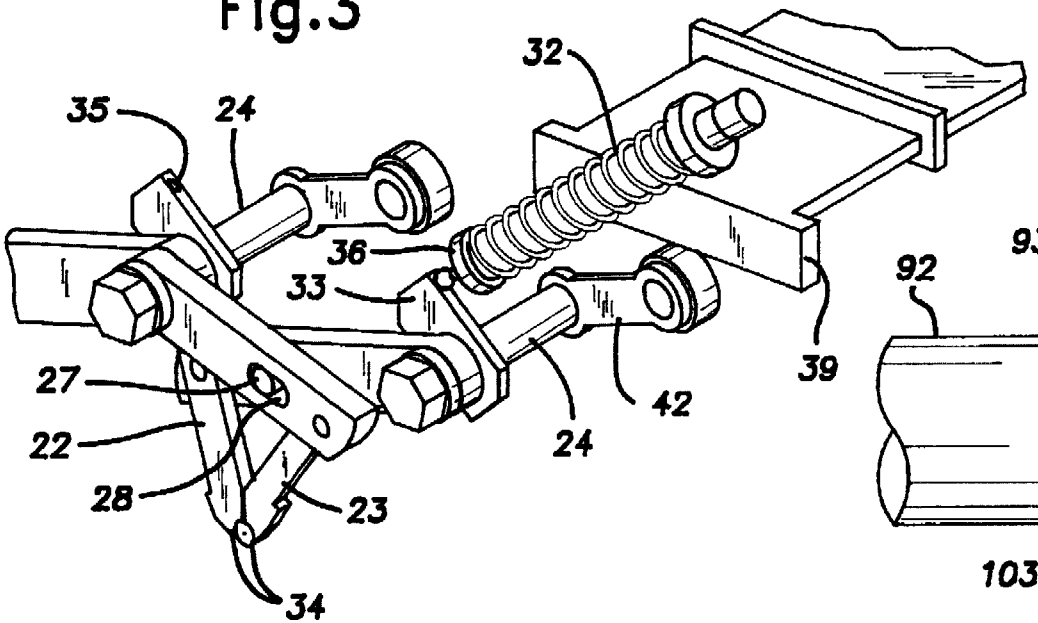
FIG. 3 is a perspective view of a pair of transfer fingers of the transfer apparatus.

Workpiece gripping elements of the transfer are in the form of opposed pivoted gripping fingers 22, 23; there is a pair of opposed fingers 2, 23 for each die station 16. The construction of each pair of fingers 22, 23 and their related parts is substantially the same from station 16 to station 16. The fingers 22, 23 each have a dog leg or angular configuration. Each finger 22, 23 has one end supported on a pin 24 for pivotal movement about the pin axis which is normally parallel to the direction of slide motion so that the fingers can pivot about respective pin axes in a plane parallel to the die breast face 17. The mating fingers 22, 23 of each pair are keyed together, so that they open and close in unison, by a pin 27 (FIG. 3) fixed to a primary one 22 of the fingers and assembled in a slot 28 formed in the mating secondary finger 23. Adjustment bolts, not shown, can be provided at the slot 28 to substantially eliminate any backlash or free play in the finger connection formed by the pin 27 and slot 28 and can be provided to adjust the rest position of the fingers. Each primary finger 22 is suitably fixed to the associated pin or shaft 24 and this shaft pivots in a bore 29 in an elongated block 31 common to all of the finger pairs or sets. The secondary fingers 23 are freely pivotal on respective ones of the shafts 24.

A compression spring 32 operates on an arm 33 fixed to each of the pins or shafts 24 to bias the associated set of fingers 22, 23 to a closed position where their gripping surfaces 34 are sufficiently close together to reliably grasp a workpiece. Each spring 32 has a fitting 36 with a hemispherical end that fits into a hemispherical socket 35 formed on each of the arms 33 to produce a universal ball and socket releasable connection. The opposite ends of the springs 32 are secured to brackets 37 fixed on a carrier body 38.

Figure 7:
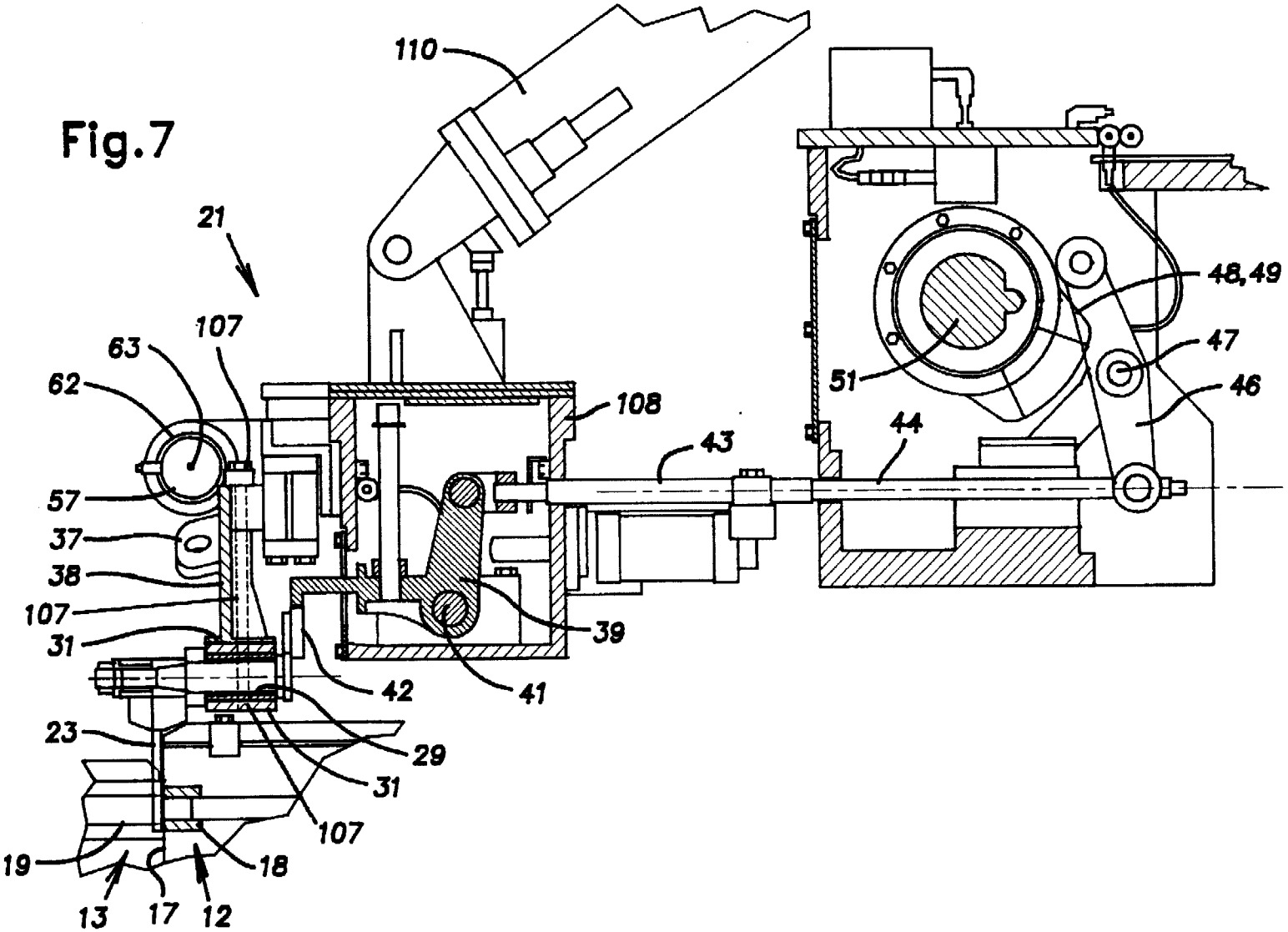
FIG. 7 is a side view partially in section of the transfer apparatus.

Each set of fingers 22, 23 is opened or closed by a respective right angle tappet or rocker arm 39 pivotal about a center 41 (FIG. 7). At appropriate times; the tappet 39 engages and depresses a roller lever 42 fixed to an end of the pivot pin or shaft 24 opposite the end to which the primary finger 22 is fixed. The tappet 39 is operated by tandem horizontal push rods 43 and 44 which, in turn, are operated by a rocker lever 46 pivoting on a center 47. The rocker lever 46 is pivoted by an associated pair of cams 48, 49 locked on a cam shaft 51. The pair of cams 48, 49, for opening and closing the fingers 22, 23, can be independently adjusted on the cam shaft 51, by known means, to precisely set the timing of opening and closing of the fingers 22, 23. The cam shaft 51 is journalled on the frame 11 for rotation about its longitudinal axis which is parallel to the die breast face 17 and is in a horizontal plane.

The cam shaft 51, as shown, carries a pair of cams for each die station 16 and it is driven in timed relation to the reciprocation of the slide through a sprocket 52 and chain 53 connected to the drive of the motor 14 in a known manner. Reference can be made to U.S. Pat. No. 4,910,993 for additional details of this drive the sprocket 52 herein corresponding to the pulley or sprocket 34 of such patent.

Figure 2:
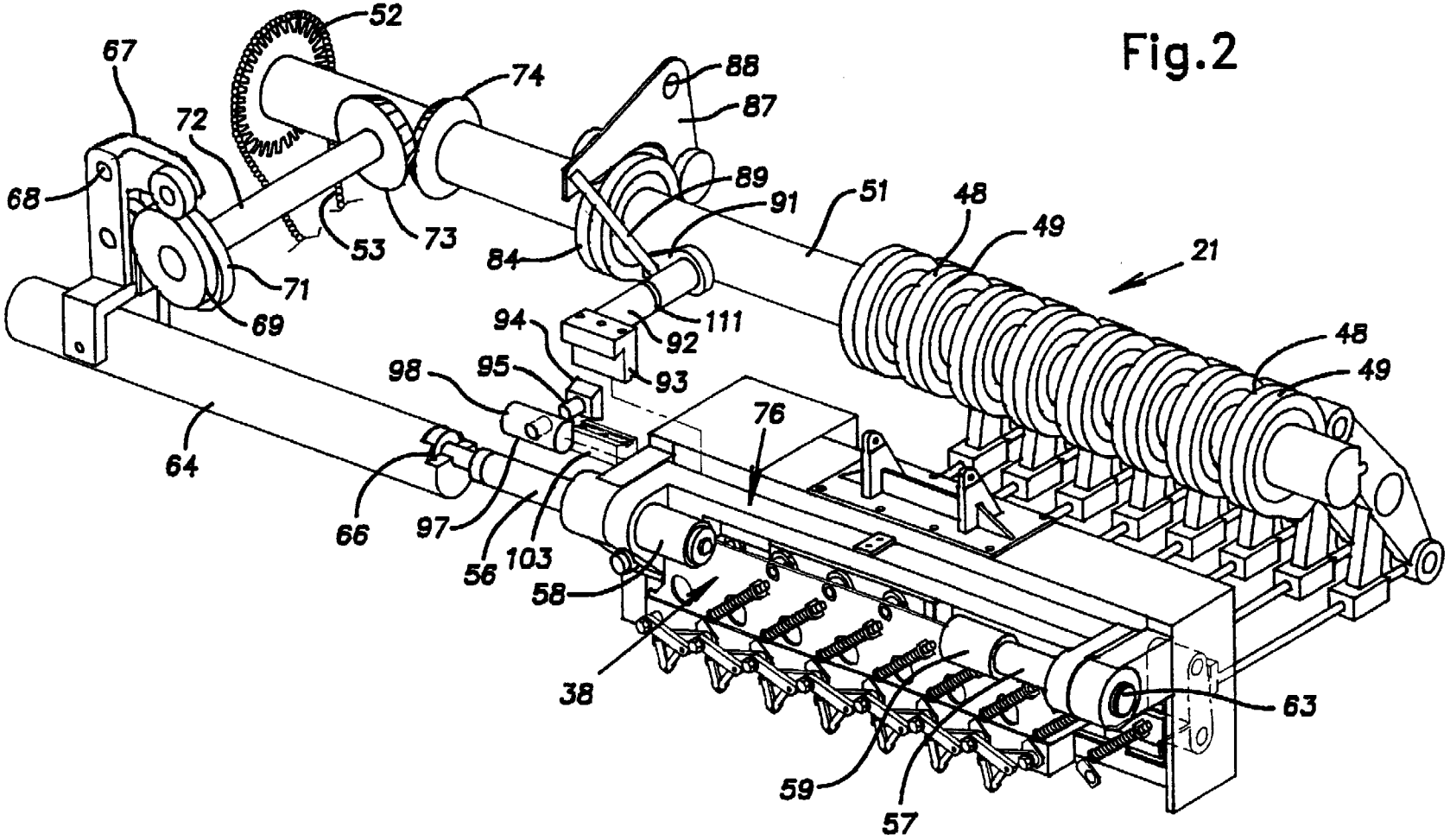
FIG. 2 is a perspective schematic view of the transfer apparatus.
Figure 4:
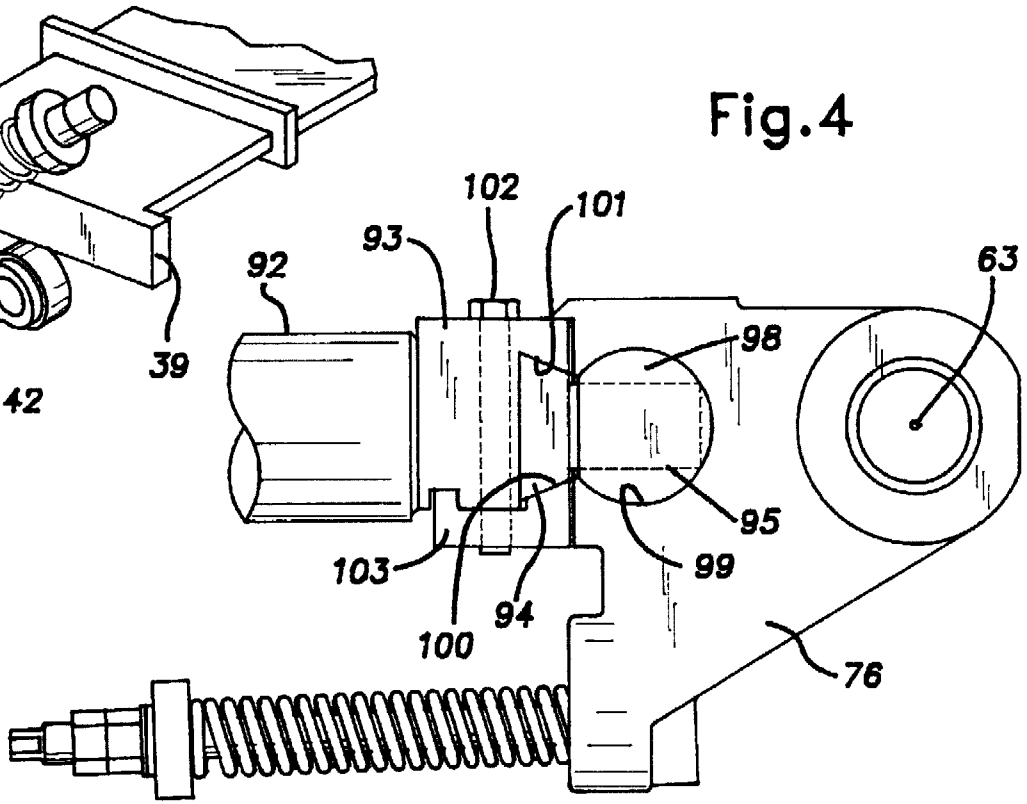
FIG. 4 is a fragmentary side elevational view of the transfer apparatus showing component details for adjustably pivoting finger gripping surfaces substantially axially from and towards the dies.

The carrier body 38 for the transfer fingers 22, 23 has a pair of coaxial shafts 56, 57 rigidly affixed to a pair of integral bosses 58, 59. The shafts 56 support the carrier body 38 in bearings 61, 62 for translatory movement in a horizontal direction parallel to the die breast face 17 and for pivotal movement about their common axis 63. As is discussed in more detail hereinbelow, the horizontal movement of the carrier body 38 results in displacement of the pairs of fingers 22, 23 back and forth between respective die stations 16 and pivotal movement of the carrier body allows the fingers to grip workpieces to move them axially out of and into respective dies. With particular reference to FIG. 2, a bar 64 interconnects to the shaft 56 by a hook 66 and drives the carrier body in its horizontal motion. The bar 64 is supported in suitable bushings (not shown) and is driven back and forth along its longitudinal axis under the influence of a rocker arm 67. The arm 67, pivoting about a fixed center 68 follows the profile of a pair of cams 69, 71 fixed on a rotating shaft 72. The shaft 72 is driven in timed relation to the slide 13 by a bevel gear 73 meshing with another bevel gear 74 on the cam shaft 51. The cams 69, 71 produce a longitudinal displacement of the bar 64 equal to the spacing between adjacent die stations 16.

Figure 1:
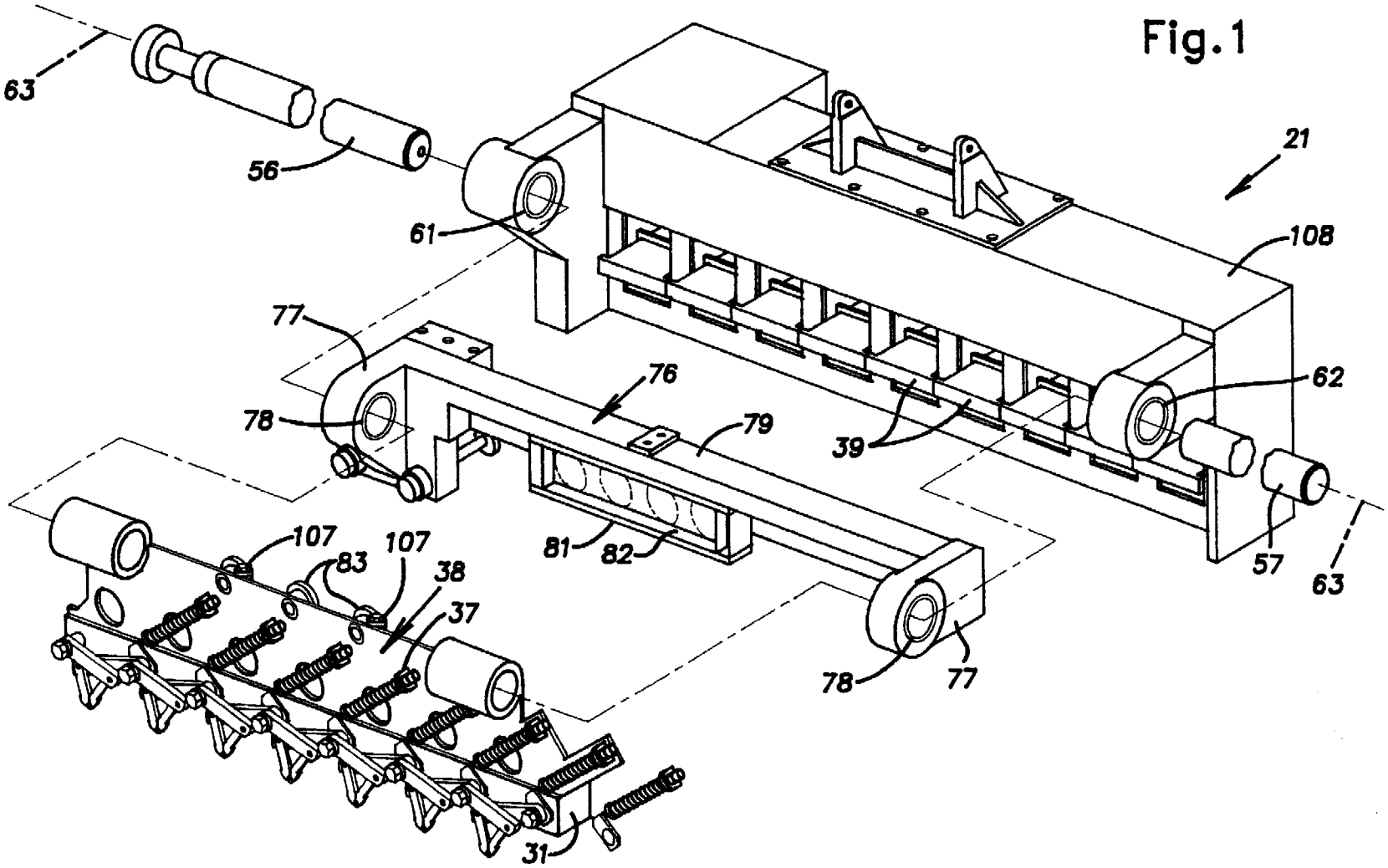
FIG. 1 is an exploded perspective view of a carrier body, cradle and tappet housing of a transfer apparatus embodying the invention.

A cradle 76 (FIG. 1) serves to pivot the carrier body 38 about the axis 63. The cradle 76 includes a pair of extensions 77 with cylindrical bushings 78 assembled on respective shafts 56, 57. The cradle 76 includes a bight section 79 between the extensions 77. A channel 81 on the bight section 79 forms a horizontal run or track 82 for a set of cam follower type rollers 83 with their shafts fixed in a spaced horizontal pattern on the carrier body 38. When the cradle 76 is in assembled relation to the carrier body 38 (FIG. 2), the rollers 83 are received in the channel track 82 so that the rollers and track provide a driving interconnection between the cradle and carrier body which allows the carrier body to reciprocate along a path parallel to the axis 63 without equivalent movement of the cradle but which causes the carrier body to pivot on the axis when the cradle is pivoted about this axis 63.

The cradle 76 is driven in a pivoting motion on the shafts 56, 57 about their axis 63 from a cam 84 on the cam shaft 51 which, as mentioned, rotates in timed relation to the reciprocation of the slide 13. This cam 84 has complementary sections that operate respective sides of a right angle rocker arm 87 that pivots about a fixed center 88. A link 89 connects an end of the arm 87 to a crank lever arm 91 of a pivot shaft 92. The pivot shaft 92 is supported in suitable bearings for pivoting motion about its longitudinal axis. The link is suitably universally connected at its ends to account for the movement paths of the rocker arm 87 and crank lever arm 91. The pivot shaft 92, at an end proximate to the transfer cradle 76, has an eccentric arm 93 fixed to it. Clamped on the arm 93, with dovetail-like surfaces, is a block 94 with an integral cylindrical pin 95 that has its axis parallel to the axis of the pivot shaft 92. The pin 95 is received in a closely fitting hole 97 in a flat side of an otherwise cylindrical coupler body 98. The coupler body 98 is received in a close fitting bore 99 in the cradle 76.

Pivoting of the shaft 92 about its longitudinal axis and consequent lowering or raising of the pin 95, causes the coupler body 98, in which the pin is received, to lower or raise the adjacent part of the cradle 76 and, consequently, causes the cradle to swing or pivot about the axis 63. It will be understood that to accomplish these various movements, the pin 95 slides and rotates to a limited extent in the bore or hole 97 and, similarly, the cylindrical coupler body 98 slides and rotates in the bore 99. As stated earlier, when the cradle swings or pivots about the axis 63, a corresponding pivotal movement of the carrier body 38 is produced by the coupling between the cradle track 82 and rollers 83.

The amplitude of pivotal movement of the carrier body 38 about the axis 63 is proportional to the eccentricity of the pin 95 from the axis of the pivot shaft 92. This eccentricity is adjustable along the dovetail surfaces, designated 100 and 101. When in a desired location, the pin 95 and the integral block 94 are clamped by tightening bolts 102 that draw a clamping bar 103 into tight engagement with the block and the block with the arm 93.

With particular reference to FIG. 7, it can be seen that the axis 63 about which the cradle 76 and carrier body 38 pivot is closely adjacent the plane of the die breast face 17 and is substantially above the center lines of the die stations. In the illustrated case, for example, the axis 63 is spaced above the center lines of the die stations 16 a distance equal to about 2½ times the spacing between adjacent die stations. Further, it will be seen that pivotal motion of the carrier body 38, in a clockwise direction in FIG. 7, will result in the transfer fingers 22, 23 at their gripping surfaces 34 moving substantially in the axial direction of the dies, i.e. in the axial direction of movement of the slide 13. In one preferred embodiment, the range of movement of the finger gripping surfaces 34 axially away from and towards the dies is between 3 and 24 millimeters depending on the adjustment of the eccentricity of the pin 95 from the axis of the pivot shaft 92.

The disclosed transfer apparatus 21 operates in a unique sequence of motions that enables it to reliably transfer workpieces that are traditionally difficult to handle such as those with relatively large stepped diameters and relatively short lengths.

Figure 5:
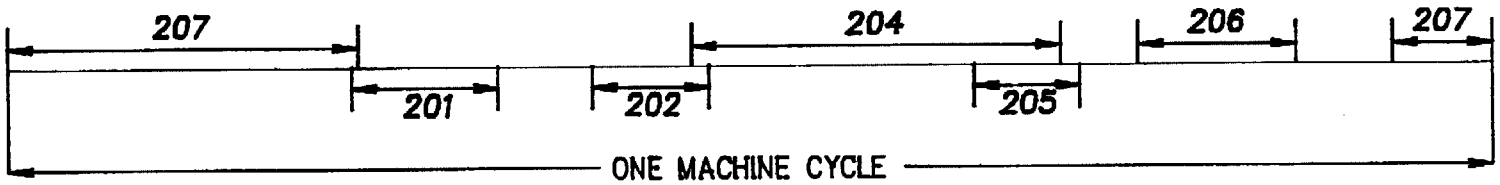
FIG. 5 is a timing diagram showing movements of components of the transfer apparatus in relation to movement of the slide.

FIG. 5 illustrates a typical timing diagram for the motions of the transfer apparatus 21 in relation to the motion of the heading slide 13 through a machine cycle of 360° of rotation of the crankshaft 15 in FIG. 8 about a center 104. The crank angle is shown developed as a horizontal line in FIG. 5; the zero value (at the left) is taken as the position of the slide closest to the die breast 17.

The cams 48 and 49, 69 and 71, 84 are profiled to produce the motion timing illustrated in FIG. 5. The fingers 22, 23 close on the respective workpieces in a period 201 of the diagram when the slide is retracting from the die breast 12 and a conventional kickout mechanism urges the workpieces, that have just been forged, partially out of the respective dies. Period 202 represents the pivotal movement of the carrier body 38 in which the finger gripping surfaces 34 move the workpieces substantially axially away from or towards the die breast face 17 and which occurs after the fingers are closed on the workpieces (at 201) and when the slide 13 is nearly fully retracted from the die breast 12. This motion causes the workpieces or blanks to be fully drawn out of the dies from which they are being discharged while being reliably gripped to assure that they will not be dropped.

Period 204 represents lateral movement of the carrier body 38 and fingers 22, 23 as they are loaded with workpieces and move laterally from discharging die stations to receiving die stations. It will be observed that during this movement, the fingers and workpieces remain axially extended in front of the dies.

Figure 6:
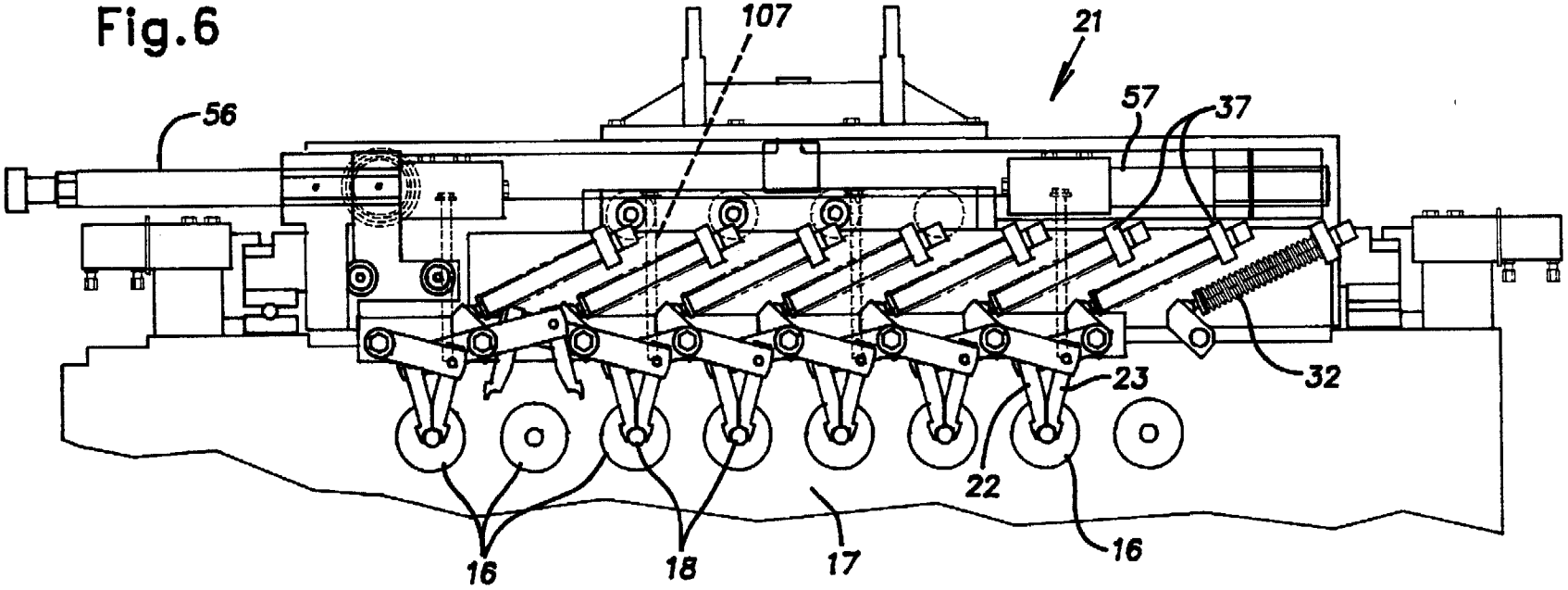
FIG. 6 is a front elevational view of the transfer apparatus.

As the fingers 22, 23 arrive in a receiving station, the fingers move the workpieces axially into the receiving dies as illustrated by period 205. After the workpieces are axially inserted into the dies by the transfer fingers the slide has begun to advance the punches carried thereon toward the dies and eventually the punches are in a position to retain the workpieces in the respective dies. Thereafter, as illustrated by period 206, the fingers are opened. For purposes of illustration, the pairs of fingers in FIG. 6 at the second station from the left are in a fully opened position and it will be understood that at this time in the machine cycle all of the fingers will be fully opened. Study of the open finger position of FIG. 6, at the second station, reveals that there is sufficient clearance beneath the lower edges of the open fingers 22, 23 to clear even large punches. The full open position of the fingers allows the carrier body 38 to return the fingers laterally back to the starting die positions, illustrated by the period 207, with the lower tips of the fingers passing over the punches on the slide extending to the dies.

It will be appreciated that the mass of the transfer elements that both translate and pivot with the carrier body 38 is relatively small allowing for relatively high speed operation. The transfer fingers, 22, 23, pivot pins 24, roller levers 42 and spring arms 33 for the several die stations are all carried by the carrier block 31. In accordance with the invention, the bar or block 31 is attached to the main part of the carrier body 38 by a set of bolts 107, enabling the fingers 22, 23 (with the pins 24 and arms fixed thereon) to be removed as a cassette with the block while leaving the remainder of the transfer apparatus installed on the machine. The springs 32 remain with the main part of the carrier body 38. This facilitates changeover of the machine when different parts are being made since another set of fingers properly adjusted on a different cassette bar or block can be simply substituted. For purposes of providing access to the die area, parts of the transfer apparatus including the carrier body 38, cradle 76 and a tappet housing 108, including the tappet elements 39, can be swung up on an arm 110 (FIG. 8) about a pivot center 109. This swing-up movement is accomplished through the hook connection between the shaft 56 and bar 64, a separable simple abutment between the push rods 43, 44 and a separable coupling 111 of known construction in the pivot shaft 92.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

We claim:

1. A forging machine comprising a frame including a die breast having a face providing a plurality of die stations and associated dies for progressively forming a workpiece as it is worked at successive stations, a slide mounted on the frame for reciprocation towards and away from the die breast and carrying tools that cooperate with dies at respective stations on the die breast to shape workpieces, a transfer apparatus on the machine to transport workpieces successively between stations, the transfer apparatus including sets of opposed fingers with gripping surfaces adjacent the die breast face for simultaneously gripping a plurality of workpieces during a machine cycle, each set of fingers being adapted to receive a workpiece at an associated receiving station and to deliver the workpiece to an associated delivery station, power operated means for sequentially closing the transfer fingers, moving the transfer finger gripping surfaces from the face of the die breast in a first direction substantially perpendicular to the face of the die breast to carry respective workpieces substantially axially out of associated dies, moving said transfer fingers in a second direction parallel to the face of the die breast to carry respective workpieces to a successive die station, moving said finger gripping surfaces in a third direction opposite said first direction to deliver workpieces axially into successive dies stations, opening said transfer fingers to a position where they are laterally away from the tools on the slide, and moving said transfer fingers in a fourth direction opposite said second direction while said fingers are open, said die stations having centers in a common plane and said fingers being arranged, when open and laterally away from the tools on the slide, on a single side of said common plane.

2. A forging machine comprising a frame including a die breast having a face providing a plurality of die stations and associated dies for progressively forming a workpiece as it is worked at successive stations, a slide mounted on the frame for reciprocation towards and away from the die breast and carrying tools that cooperate with dies at respective stations on the die breast to shape workpieces, a transfer apparatus on the machine to transport workpieces successively between stations, the transfer apparatus including sets of opposed fingers with gripping surfaces adjacent the die breast face for simultaneously gripping a plurality of workpieces during a machine cycle, each set of fingers being adapted to receive a workpiece at an associated receiving station and to deliver the workpiece to an associated delivery station, power operated means for sequentially closing the transfer fingers, moving the transfer finger gripping surfaces from the face of the die breast in a first direction substantially perpendicular to the face of the die breast to carry respective workpieces substantially axially out of associated dies, moving said transfer fingers in a second direction parallel to the face of the die breast to carry respective workpieces to a successive die station, moving said finger gripping surfaces in a third direction opposite said first direction to deliver workpieces axially into successive dies stations, opening said transfer fingers to a position where they are laterally away from the tools on the slide, and moving said transfer fingers in a fourth direction opposite said second direction while said fingers are open, said die stations having centers in a common plane, said first and third directions of movement being along an arc having its center spaced laterally from the plane of the centers of the dies and adjacent the plane of the face of the die breast.

3. A forging machine as set forth in claim 2, wherein said transfer fingers are arranged to open by pivotal movement on respective centers.

4. A forging machine as set forth in claim 3, wherein said transfer finger opening pivot centers are located laterally away from their respective die center.

5. A forging machine as set forth in claim 4, wherein the opening pivot centers of the transfer fingers lie in the same lateral direction relative to the plane of the die station centers as the center for arcuate movement for the first and third directions lies with respect to the plane of the die station centers.

6. A forging machine as set forth in claim 1, including a pivot member with a variable effective length for selectively adjusting the distance that said transfer fingers are moved in said first and third directions.

7. A forging machine comprising a frame including a die breast having a face providing a plurality of die stations and associated dies for progressively forming a workpiece as it is worked at successive stations, a slide mounted on the frame for reciprocation towards and away from the die breast and carrying punches that cooperate with dies at respective stations on the die breast to shape workpieces, said die stations being centered along a line along the face of the die breast, a transfer apparatus to transport workpieces successively between stations, the transfer apparatus including a rigid carrier for supporting said fingers, means supporting said carrier for pivotal movement about an axis parallel to the line on which the die stations are centered; said gripping fingers being carried on said carrier and extending from said carrier laterally towards associated dies, pivotal movement of said carrier causing gripping ends of the fingers to move away from or towards said dies in arcuate paths substantially perpendicular to the face of the die breast, said fingers being individually pivoted about respective pivot axes on the carrier perpendicular to the face of the die breast such that opposed pairs of fingers can be opened or closed by relative pivotal movement about the associated finger pivot axes, means for supporting the carrier for translatory movement in a direction parallel to the line on which said dies are centered, power operated means to sequentially close each set of said fingers to receive a workpiece, pivot said carrier to swing the gripping ends of said fingers away from the face of said die breast and draw workpieces free of the dies, move said carrier from a receiving position to a delivery position, pivot said carrier to swing the gripping ends of said fingers toward the face of the die breast, open said fingers so that they are substantially laterally spaced from the center of the associated dies, and return the carrier to the receiving position.

8. A forging machine as set forth in claim 7, wherein said fingers are assembled on pivots on a common block that forms a part of the carrier and is removable with said fingers and pivots from remaining portions of said carrier as a cassette.

9. A forging machine as set forth in claim 7, wherein said power operated means includes adjustment means to selectively adjust the amplitude of the pivotal movement of the carrier and the distance that the fingers move away from the face of the die breast.

* * * * *